US005628082A

United States Patent [19]

Moskovich

[11] Patent Number: 5,628,082

[45] Date of Patent: May 13, 1997

[54] TOOTHBRUSH WITH IMPROVED EFFICACY

[75] Inventor: Robert Moskovich, East Brunswick, N.J.

[73] Assignee: Colgate-Palmolive Company, New York, N.Y.

[21] Appl. No.: 406,333

[22] Filed: Mar. 22, 1995

[51] Int. Cl.[6] ..... A46B 9/04

[52] U.S. Cl. ..... 15/110; 15/143.1; 15/167.1; 15/188; 601/141; D4/104

[58] Field of Search ..... 15/110, 143.1, 15/167.1, 188; 601/139, 141; D4/104, 108

[56] References Cited

U.S. PATENT DOCUMENTS

| | | | |
|---|---|---|---|
| D. 45,199 | 2/1914 | McDonagh et al. | D4/104 |
| D. 45,572 | 4/1914 | Sarrazin . | |
| D. 49,472 | 8/1916 | Dierile | D4/105 |
| D. 53,453 | 6/1919 | Lloyd | D4/108 |
| D. 57,327 | 3/1921 | Gibson | D4/104 |
| D. 101,080 | 9/1936 | Cosad | D4/105 |
| D. 113,743 | 3/1939 | Kahn | D4/107 |
| D. 113,744 | 3/1939 | Kahn | D4/107 |
| D. 136,156 | 8/1943 | Fuller | D4/104 |
| D. 139,532 | 11/1944 | Trecek . | |
| D. 141,350 | 5/1945 | Alexander et al. . | |
| D. 144,163 | 3/1946 | Dolnick . | |
| D. 146,271 | 1/1947 | Stavely . | |
| D. 154,598 | 7/1949 | Gass . | |
| D. 155,668 | 10/1949 | Zandberg et al. . | |
| D. 157,669 | 3/1950 | Graves, Jr. . | |
| D. 160,101 | 9/1950 | MacDonald . | |
| D. 163,707 | 6/1951 | Pifer . | |
| D. 169,131 | 3/1953 | Fay . | |
| D. 170,680 | 10/1953 | Del Mas . | |
| D. 173,616 | 12/1954 | Hernandez . | |
| D. 265,698 | 8/1982 | Roth . | |
| D. 270,972 | 10/1983 | Rosofsky . | |
| D. 274,018 | 5/1984 | Usui . | |
| D. 281,202 | 11/1985 | Thompson | D4/104 |
| D. 284,236 | 6/1986 | Collet | D4/104 |
| D. 284,528 | 7/1986 | Jurado | D4/105 |
| D. 287,073 | 12/1986 | Thompson | D4/105 |

(List continued on next page.)

FOREIGN PATENT DOCUMENTS

| | | |
|---|---|---|
| 0449655 | 10/1991 | European Pat. Off. . |
| 0471312 | 2/1992 | European Pat. Off. . |

(List continued on next page.)

OTHER PUBLICATIONS

"The Prophylactic" Toothbrush patented 1884. 1875 Catalogue of G. Ash & Sons.

1890—Randolph Catalogue.

DM 1031737 Bulletin des Dessins et Modeles Internationaux, Jan. 1995, p. 81.

DM1031907, International Designs Bulletin, Jan. 1995, p. 356.

DM1031738 Bulletin des Dessins et Modeles Internationaux, Jan. 1995, p. 82.

*Primary Examiner*—Mark Spisich

*Attorney, Agent, or Firm*—Richard J. Ancel; James M. Serafino

[57] ABSTRACT

An improved toothbrush with a secure grip, a more effective bristle arrangement, and a specially shaped head is disclosed. The handle is formed with opposed gripping portions, and fits securely in the hand of the brusher, facing either up or down, imparting to the user a very secure and comfortable feeling. The toothbrush has a narrow and thin head for maximum access to the oral cavity, and a novel bristle arrangement which is highly effective for the removal of plaque from teeth with manual brushing. In one embodiment, the brush head is tapered to a narrow portion, and then optionally flares out again. In another embodiment, the head is formed with a wavy profile. In yet other embodiments, the brush head may also be provided with an upwardly curved or an angled tip. The head may also have a rubberized lower portion to effectuate gum massage, a gum stimulator, and a head with visibly different utilization areas.

38 Claims, 11 Drawing Sheets

U.S. PATENT DOCUMENTS

| | | | |
|---|---|---|---|
| D. 292,448 | 10/1987 | Vianello | D4/104 |
| D. 297,467 | 8/1988 | McCann . | |
| D. 324,957 | 3/1992 | Piano | D4/104 |
| D. 330,116 | 10/1992 | Crawford et al. | D4/104 |
| D. 330,458 | 10/1992 | Curtis et al. | D4/104 |
| D. 332,873 | 2/1993 | Hall | D4/104 |
| D. 334,472 | 4/1993 | Curtis et al. | D4/104 |
| D. 335,579 | 5/1993 | Chuang | D4/105 |
| D. 342,160 | 12/1993 | Curtis et al. | D4/104 |
| D. 342,162 | 12/1993 | Curtis et al. | D4/104 |
| D. 346,697 | 5/1994 | O'Conke | D4/104 |
| D. 347,943 | 6/1994 | Perry | D4/104 |
| D. 352,396 | 11/1994 | Curtis et al. | D4/104 |
| D. 352,829 | 11/1994 | Perry | D4/104 |
| D. 358,938 | 6/1995 | Schneider et al. | D4/104 |
| 669,402 | 3/1901 | Rose | 15/167.1 |
| 914,501 | 3/1909 | McEachern | D4/104 X |
| 958,371 | 5/1910 | Danek | D4/104 X |
| 1,018,927 | 2/1912 | Sarrazin | 15/167.1 |
| 1,059,426 | 4/1913 | Barnes | 15/167.1 |
| 1,128,139 | 2/1915 | Hoffman | 15/117 |
| 1,251,250 | 12/1917 | Libby | 15/176.1 X |
| 1,268,544 | 6/1918 | Cates | 15/110 |
| 1,296,067 | 3/1919 | Fuller | D4/109 X |
| 1,337,173 | 4/1920 | White | 15/167.1 |
| 1,382,681 | 6/1921 | Segal | 15/167.1 |
| 1,440,785 | 1/1923 | Leuis . | |
| 1,456,535 | 5/1923 | Cartwright | 15/176.4 |
| 1,488,214 | 3/1924 | Mason . | |
| 1,494,448 | 5/1924 | Sookne . | |
| 1,497,495 | 6/1924 | Fincke | 15/176.6 |
| 1,527,853 | 2/1925 | Ferdon | 15/176.2 X |
| 1,588,785 | 6/1926 | Van Sant . | |
| 1,639,880 | 8/1927 | Butler . | |
| 1,676,703 | 7/1928 | Nuyts | 15/176.3 |
| 1,794,711 | 3/1931 | Jacobs | 15/176.1 |
| 1,916,641 | 7/1933 | Seeliger | 15/167.1 |
| 1,927,365 | 9/1933 | Frolio | 15/167.1 |
| 2,016,644 | 10/1935 | Luball . | |
| 2,042,239 | 5/1936 | Planding | 15/188 X |
| 2,114,947 | 4/1938 | Warsaw | 15/167.1 |
| 2,168,964 | 8/1939 | Strasser | 15/167.1 |
| 2,209,173 | 7/1940 | Russell | 15/167.1 |
| 2,226,663 | 12/1940 | Hill et al. . | |
| 2,244,098 | 6/1941 | Busick | 15/172 |
| 2,279,355 | 4/1942 | Wilensky | 15/110 |
| 2,401,186 | 5/1946 | Price . | |
| 2,414,775 | 1/1947 | Stavely | 15/167.1 |
| 2,429,740 | 10/1947 | Aufsesser | 15/167.1 |
| 2,533,345 | 12/1950 | Bennett | 15/167.1 |
| 2,558,332 | 6/1951 | Artale | 15/167.1 |
| 2,618,003 | 11/1952 | Robey | 15/176.4 |
| 2,651,068 | 9/1953 | Seko | 15/111 |
| 2,722,703 | 11/1955 | Green | 15/143.1 |
| 2,819,482 | 1/1958 | Applegate | 15/110 |
| 2,868,215 | 1/1959 | Mechem . | |
| 2,946,072 | 7/1960 | Filler et al. | 15/110 |
| 3,103,027 | 9/1963 | Birch | 15/110 |
| 3,230,562 | 1/1966 | Birch | 15/110 |
| 3,258,805 | 7/1966 | Rossnan | 15/110 |
| 3,358,314 | 12/1967 | Matibag | 15/246 |
| 3,722,020 | 3/1973 | Hills | 15/167.1 |
| 3,742,549 | 7/1973 | Scopp et al. | 15/167.1 |
| 3,792,504 | 2/1974 | Smith | 15/167.1 |
| 4,288,883 | 9/1981 | Dolinsky | 15/110 |
| 4,571,768 | 2/1986 | Kawashimia | 15/167.1 |
| 4,776,054 | 10/1988 | Rauch | 15/167.1 |
| 4,800,608 | 1/1989 | Key | 15/167.1 |
| 4,864,676 | 9/1989 | Schaiper | 15/167.1 |
| 5,046,212 | 9/1991 | O'Conke | 15/105 |
| 5,315,731 | 5/1994 | Millar | 15/167.1 |
| 5,335,389 | 8/1994 | Curtis et al. | 15/167.1 |
| 5,339,482 | 8/1994 | Desimone et al. | 15/167.1 |
| 5,341,537 | 8/1994 | Curtis et al. | 15/167.1 |
| 5,351,358 | 10/1994 | Larrimore | 15/201 |
| 5,371,915 | 12/1994 | Key | 15/167.1 |
| 5,373,602 | 12/1994 | Bang | 15/167.1 |
| 5,392,483 | 2/1995 | Heinzelman et al. | 15/167.1 |
| 5,396,678 | 3/1995 | Bredall et al. | 15/167.1 |
| 5,398,368 | 3/1995 | Elder | 15/167.1 |

FOREIGN PATENT DOCUMENTS

| | | | |
|---|---|---|---|
| 0654232 | 5/1995 | European Pat. Off. . | |
| 683311 | 6/1930 | France | 15/167.1 |
| 1054713 | 2/1954 | France . | |
| 2331981 | 6/1977 | France . | |
| 2511586 | 2/1983 | France . | |
| 2515942 | 5/1983 | France . | |
| 2550696 | 2/1985 | France . | |
| 2587183 | 3/1987 | France . | |
| 2594307 | 8/1987 | France . | |
| 2624360 | 6/1989 | France . | |
| 2649597 | 1/1991 | France . | |
| 2700678 | 7/1994 | France . | |
| 2410175 | 9/1975 | Germany . | |
| 8513644 | 8/1985 | Germany . | |
| 3240113 | 9/1991 | Germany . | |
| 9303673 | 6/1993 | Germany . | |
| 107827 | 11/1924 | Switzerland . | |
| 120480 | 5/1927 | Switzerland . | |
| 215110 | 9/1941 | Switzerland . | |
| 333001 | 3/1959 | Switzerland . | |
| 372279 | 11/1963 | Switzerland . | |
| 539409 | 9/1973 | Switzerland . | |
| 673381 | 3/1990 | Switzerland . | |
| 681347 | 3/1993 | Switzerland . | |
| 216735 | 6/1924 | United Kingdom . | |
| 946283 | 1/1964 | United Kingdom . | |
| 94-09677 | 5/1994 | WIPO . | |
| 94-09678 | 5/1994 | WIPO . | |
| 95-06420 | 3/1995 | WIPO . | |

TOOTHBRUSH WITH IMPROVED EFFICACY

BACKGROUND OF THE INVENTION

1. Field of the Invention

The field of oral hygiene has made exceptional strides in improving overall oral health. Various toothpaste formulations, mouthwashes, dental flosses, water rinse apparatuses, and toothbrushes are on the market, and each, to a certain extent, contributes to overall oral hygiene when used properly and regularly.

However, the problem often encountered is proper use and regularity of use while toothpastes taste better than ever today, and mouth rinses promise fresh breath, the foundation for appropriate hygiene in the oral cavity is the removal of debris from the tooth, at the gumline and in between teeth. Further, the innermost reaches of the oral cavity are regularly where problems start.

Thus, there has been and continues to be a need for a toothbrush which satisfies many categories:

- it must provide effective surface area cleaning, including the top of the crown of the tooth and the frontal planar portions.
- it must provide cleaning at the gumline, where debris often accumulates out of the reach of normal tongue cleaning action.
- it must provide effective cleaning between teeth.
- it must be able to reach the most confined regions of the oral cavity easily.
- it must be capable of directing force at teeth and surfaces individually, while simultaneously allowing brushing of larger surface areas.
- it must provide comfortable and convenient use to the brusher.
- it must effectively remove plaque.

2. The Prior Art

The prior art is aware of several toothbrush elements which attempted to remedy the situation and make toothbrushing by a user more comfortable and effective. Certain toothbrushes currently marketed provide for an angled head, said to be similar to dental instruments, for reaching back teeth. Adjustable angled heads were disclosed in GB 216,735. Other toothbrushes use different bristle types or lengths to accomplish a staggered effect which is said to improve overall brushing effects. See, e.g. U.S. Pat. Nos. 1,794,711 to Jacobs, 2,618,003 to Robey, and 3,742,549 to Scopp which provide bristles of varied length for an angled effect. GB 216,735 and U.S. Pat. No. 1,676,703 to Nuyts disclose a longer tuft of bristles at the utilization end in their drawings.

U.S. Pat. Nos. 1,527,853 to Ferdon, 1,497,495 to Finke, and 1,456,535 to Cartwright each disclose a contoured bristle arrangement.

However imaginative these arrangements may be, there remains a need for a toothbrush which can provide all the features required for proper oral hygiene.

SUMMARY OF THE INVENTION

The present invention relates to a novel toothbrush with exceptional cleaning efficacy and comfortable use. More particularly, this invention relates to a toothbrush having its body shaped for maximum cleaning efficiency under a variety of conditions of use, and having bristles so arranged as to be highly effective for the removal of plaque from teeth with manual brushing.

According to the practice of this invention, the handle and head portion of the toothbrush body is formed by a variety of processes. The body is formed with a uniquely ergonomic handle which provides a secure grip for the user.

The toothbrush according to the present invention further includes a head design which has hitherto been unknown. The head of the toothbrush is formed substantially thinner than has been customary, and a longitudinal support bar provided to maintain flexural strength under pressure. In one preferred embodiment, the brush head is tapered to a narrow portion, and then optionally flares out again. In another preferred embodiment, the head is formed with a wavy appearance. In an especially preferred embodiment, the head itself has an upwardly curved tip. The head may also have a rubberized lower portion to effectuate gum massage. In a preferred practice of the present invention, the head of the toothbrush is formed so as to segment the head for different utilization areas.

Additionally, the toothbrush according to the present invention is provided with a choice of unique bristle arrangements. In a preferred embodiment, generally transverse rows of bristle bars alternate with generally transverse rows of bristle tufts to provide exceptional plaque removal at the surface area. In this regard, see the disclosure in Colgate-Palmolive's U.S. Pat. No. 5,335,389, issued Aug. 9, 1994, which is incorporated herein by reference. As taught therein, bristle bar tufts may be replaced with rows of individual tufts, but, in such case, the efficacy of the toothbrushes of the present invention would be diminished. In another preferred embodiment, bristles project outwardly around the perimeter of the brush head to reach and clean the gumline simultaneously. This results in a uniform cleaning action substantially independent of brushing direction or technique. See also Colgate-Palmolive's U.S. Pat. No. 5,341,537, issued Aug. 30, 1994, which is incorporated herein in its entirety by reference.

In yet another embodiment, a substantially densely packed or solid circular cleaning means is formed in the center of a first bristle area on the usage end of the brush head for cleaning individual teeth. A gum massager can also be incorporated into this end of the toothbrush. In a particularly preferred embodiment a cleaning means is shaped into a scoop form to remove accumulated debris. Applicant has also determined that varying the bristle length in these specific arrangements is unexpectedly beneficial.

According to the present invention, the bristle quantity itself has been altered, with surprising consequences. By providing larger overall tufts with more bristles, the head size has been lowered, yet cleaning power improved. A novel rubber bristle bar in the practice of the present invention provides squeegee action which removes debris loosened by the regular bristles.

DETAILED DESCRIPTION

DETAILED DESCRIPTION WITH REFERENCE TO THE DRAWINGS

Figure 1:
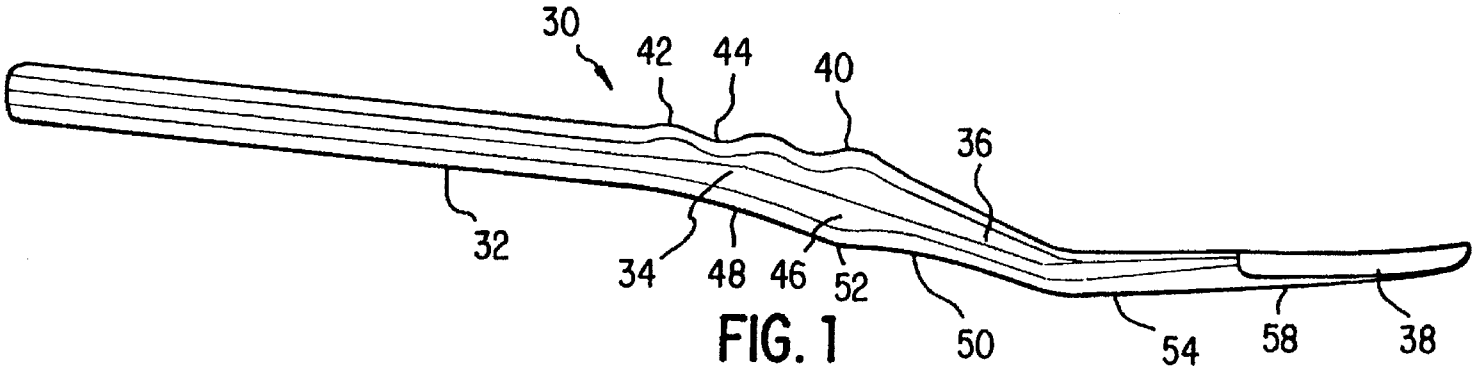
FIG. 1 is a side view of a toothbrush handle and head portion formed in accordance with this invention.

The toothbrush according to the present invention has a combination of novel features which yield an exceptional cleaning efficacy combined with a high level of comfortable use. This comfortable arrangement is made possible by a novel handle shape, while the efficacy is provided by a novel head and bristle structure as more completely detailed herein. In some Figures, like elements will be denoted by the same reference numerals.

The ergonomics of the toothbrush handle have long been overlooked. As everyday experience shows, brushing of teeth occurs under wet conditions, even in the shower, and not all the presently available toothbrushes, which are formed from rigid plastic materials and can be slippery when wet, provide prevention against slippage. Vigorous usage of the toothbrush in the oral cavity without complete control over a toothbrush handle can result in injuries not limited to gum stabbing from inappropriately positioned bristles. The oral cavity is very delicate, and injuries thereto are extremely painful, especially when those injuries are repeatedly insulted.

FIG. 1 details one aspect of the present invention which solves the slippage problem. Toothbrush body 30 is formed with a handle portion 32, a grip portion 34, a neck portion 36, and a head portion 38. The body is formed by any one of a variety of measures which are known in the art, such as casting or injection molding of a suitable thermoplastic material.

Handle portion 32 is substantially straight, and is useful for storing the toothbrush in a standard toothbrush holder. Grip portion 34 is formed with a first grip portion 40 having multiple, preferably at least three, protrusions 42 from the handle body.

The thumb of a user securely rests within at least one of the indentations 44 formed between the protrusions. This enables the brush to be held in the bristle-up position and applied to the tooth surface securely without fear of slippage. When the toothbrush is used in the bristle-down position to clean the lower teeth, the multiple indentations provide finger rests, and the multiple protrusions provide purchase for the fingers to prevent slippage. The toothbrush can be reversed during brushing (i.e. the hand position does not change, but the brush orientation is reversed to clean the opposite set of teeth). No loss in grippability ensues.

Second grip portion 46 is also formed in grip area 34, but is formed on the opposite side of the body of the grip region from the first grip portion 40. Second grip portion 46 is formed with at least two indented curvatures 48 and 50. The proximity of indented curvatures 48 and 50 results in a lower protrusion 52. Lower protrusion 52 acts in a similar manner to upper protrusions 42, and gives the digits engaged thereto purchase for lateral motion without slippage, Neck portion 36 is generally formed with an angled portion 54. This angle enables the head to be more appropriately positioned within the mouth to engage the bristles correctly against the teeth.

Head portion 38 is formed substantially thinner than conventional toothbrushes. This thinness results in a lower head profile, giving added maneuverability within the oral cavity and access to hard-to-reach places therein support beam 60 (see FIG. 2) provides flexural support for head 38 without requiring the overall head portion height to increase substantially.

Figure 2:
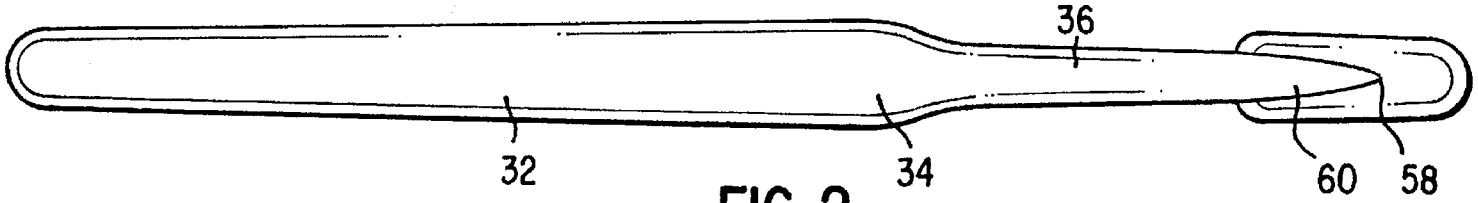
FIG. 2 is a bottom view of a toothbrush handle and head portion formed in accordance with of this invention.
Figure 3:
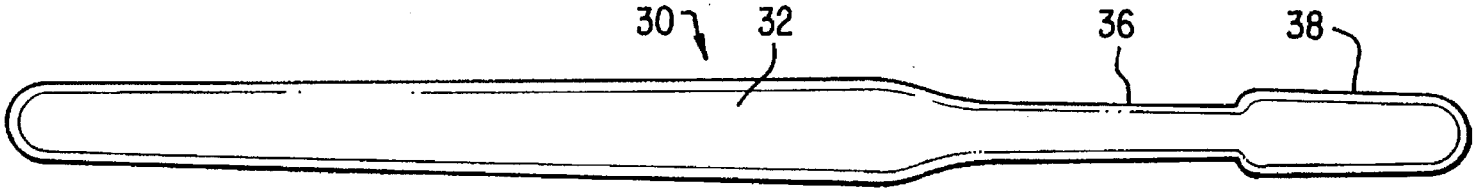
FIG. 3 is a top view of a toothbrush handle and head portion formed in accordance with this invention.
Figure 4:
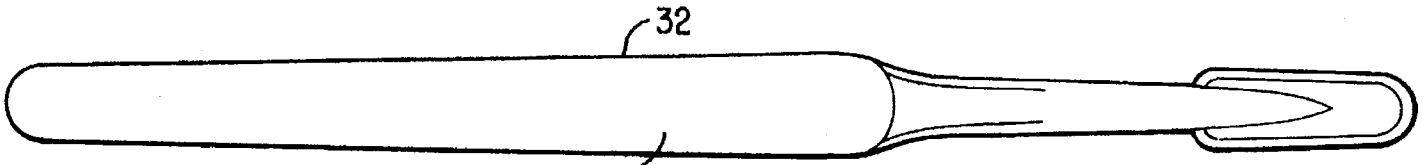
FIG. 4 is a bottom view of a rubberized handle embodiment of the present invention.

FIG. 2 more clearly shows the underside of a brush body according to the present invention. Neck portion 36 is substantially thinner than handle portion 32 or grip portion 34. The neck portion tapers to point 58 forming head support beam 60. FIG. 3 shows the top view thereof. FIG. 4 illustrates a particularly preferred embodiment of the lower portion of the brush handle of the present invention. Handle portion is formed with resilient lower grip material 62, which enables the handle to be securely held. The resilient grip material may be rubber, rubber-like (i.e. "Santoprene") or a suitable deformable thermoplastic material which is formed in a thin layer while the resilient material may be attached with an appropriate adhesive, in a preferred manner, it may be mated to the rigid plastic by an injection molding process.

Figure 5:
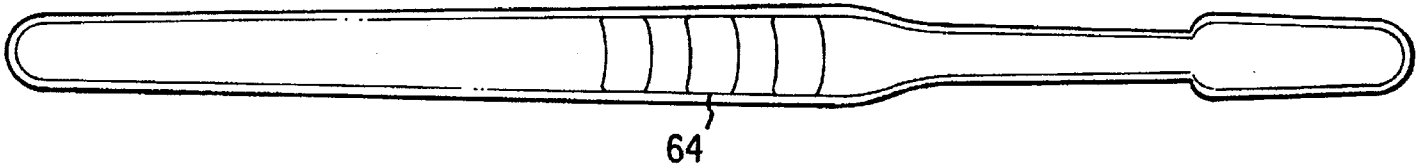
FIG. 5 is a top view of a rubberized handle embodiment of the present invention.

FIG. 5 illustrates the upper portion of the brush handle of FIG. 4. The resilient upper grip material 64 is formed into the forward portions of indentations 44, providing excellent traction and a secure gripping purchase for the engaged digits.

Figure 6:
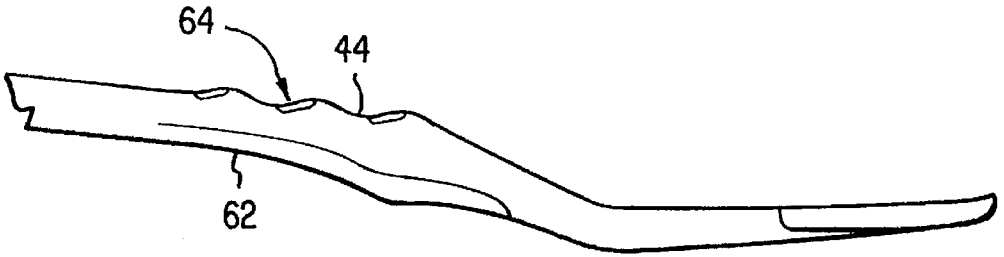
FIG. 6 is a side view of a rubberized handle embodiment of the present invention.

FIG. 6 illustrates a side view of the rubberized handle according to the present invention. Resilient upper grip material 64 is visible adhered to the forward portion of indentations 44. Resilient lower grip material 62 is adhered to the lower grip portion. Such a combination gives, with moderate exertion and even under wet conditions, a firm and secure grip. Such a secure, comfortable grip has the added benefit of preventing accidental brushing injury, while concurrently making brushing more pleasant and encouraging it more regularly.

Figure 7:
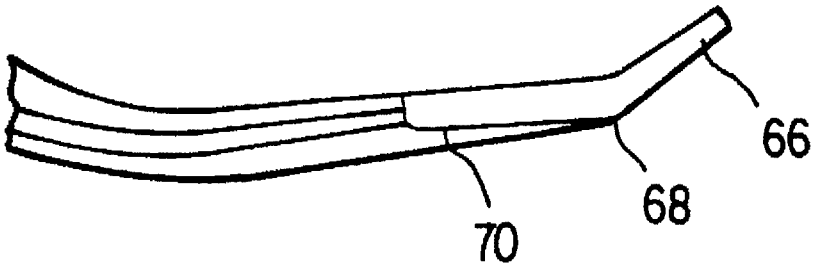
FIG. 7 is a side view of a preferred angled head embodiment according to the present invention.

FIG. 7 is a side view of an angled head portion according to the present invention. This acts to provide either uplifted bristles, or lower the head profile to enable greater access to the rear portion of the oral cavity. The angled head portion 66 is connected by angle 68 formed in the otherwise planar head portion. Support bar 70 may extend out to the angle to provide support for the head and greater angular motion resistance.

Figure 8:
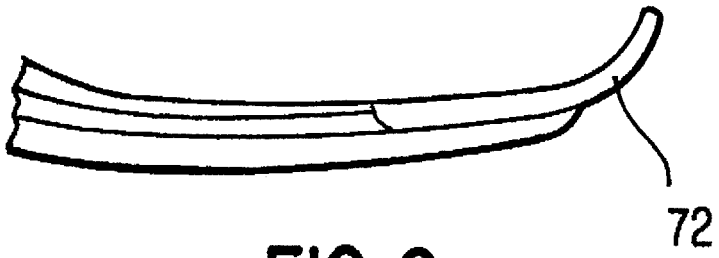
FIG. 8 is a side view of a preferred curved head embodiment according to the present invention.

FIG. 8 illustrates an embodiment of the non planar head portion. The head is formed with curved portion 72, which again reduces the clearance required by the head portion and also can reduce the incidence of a direct gum strike by an inflexible head portion. The curve will cause the head to strike a less destructive glancing blow to the delicate gum tissues.

Figure 9:
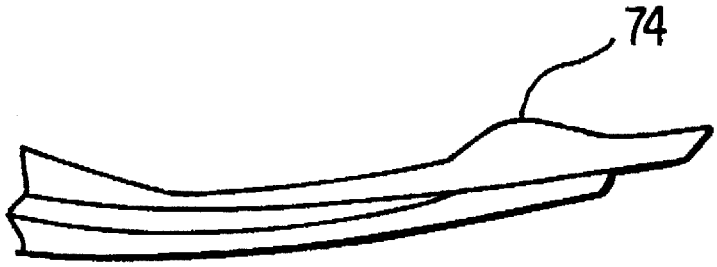
FIG. 9 is a side view of a raised head embodiment according to the present invention.

FIG. 9 illustrates an embodiment of the head with a raised portion 74, which may be convex to the head surface. This enables the bristles to extend outwardly, provides further flexural support, and can give the bristles a contoured appearance.

Figure 10:
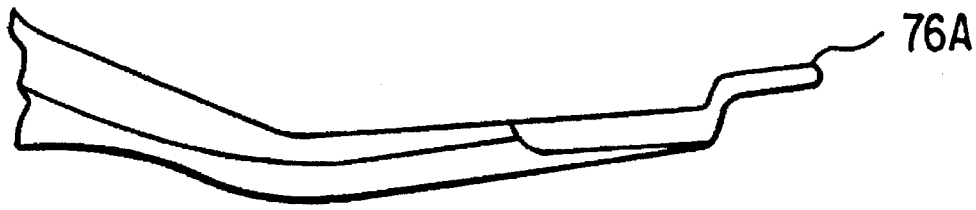
FIG. 10 is a side view of a partially raised head embodiment.

FIG. 10 illustrates an embodiment of the present invention. A portion 76A of the head is elevated. This acts to reduce the head clearance at the utilization end to provide greater access.

Figure 11:
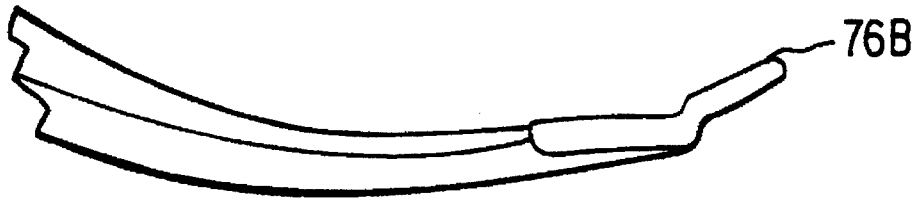
FIG. 11 is a side view of a raised and angled head embodiment.

FIG. 11 illustrates a combination of an elevated and angled head utilization end 76B.

Figure 12:
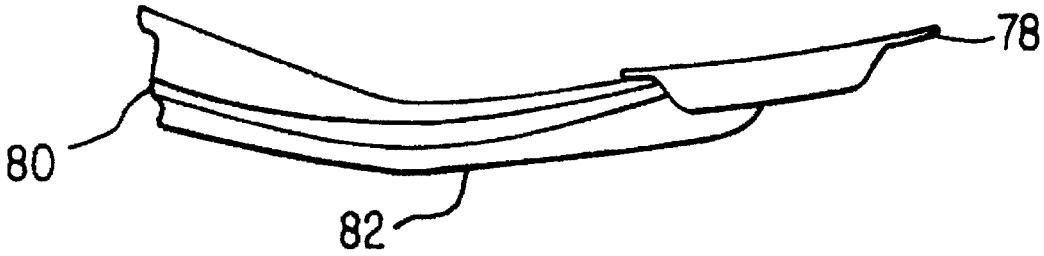
FIG. 12 is a side view of a free-formed head embodiment.

FIG. 12 illustrates an extremely gum-friendly and low profile head. The so-called free-formed head is flexible, can navigate the closest quarters, and causes very little injury to the oral mucosa it may encounter. The free-formed head is formed with a thin external perimeter 78, and is supported by support beam 82, optionally formed with internal channel 80.

Figure 13:
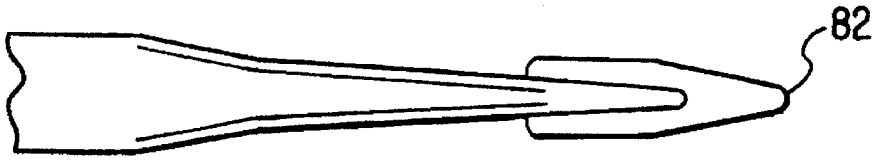
FIG. 13 is a top view of a tapered head embodiment.

FIG. 13 is a top view illustrating the preferred tapered head embodiment which has a narrow point 82. A tapered head provides excellent access to hard-to-reach portions of the oral cavity from an angle. The tip can swivel and rotate far freer than a full sized tip. This has the unexpected additional benefit of concentrating brushing force in an appropriate direction.

Figure 14:
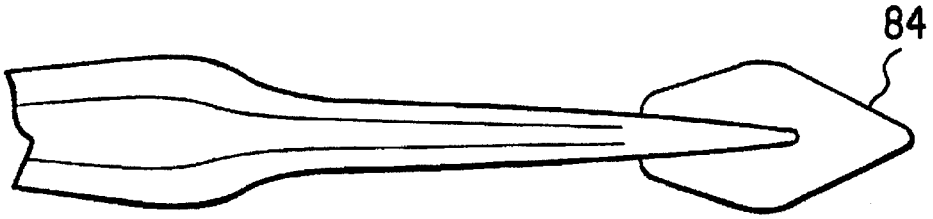
FIG. 14 is a top view of a tapered head embodiment with rounded edges.

FIG. 14 is a preferred embodiment of FIG. 13, having flared curved sides 84. This provides more head surface area, yet still enables the tapered head substantially improved access into the oral cavity.

Figure 15:
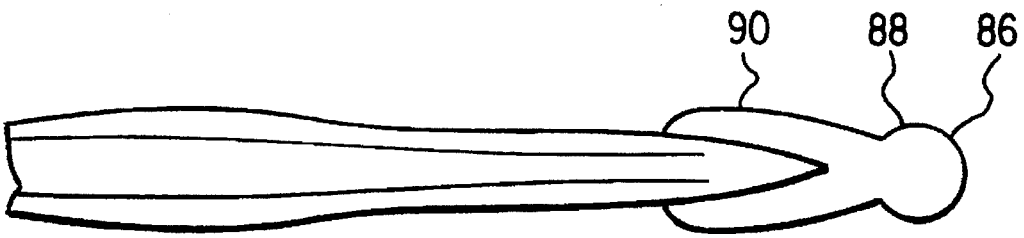
FIG. 15 is a top view of a tapered head embodiment with a rounded tip.

FIG. 15 is another embodiment of the head having a round end portion 86. This round end portion can support a rounded pattern of bristles and concentrate brushing force at specific areas within the mouth. Indentations 88 delimit the round end portion from the tapered sides 90.

Figure 16:
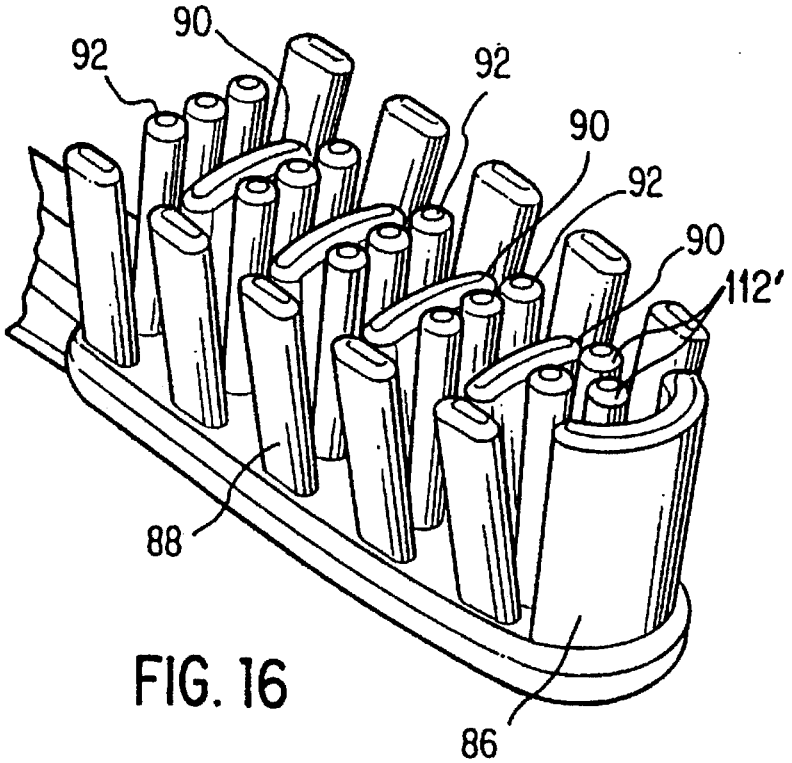
FIG. 16 is a perspective view of a bristle arrangement according to the present invention.

FIG. 16 illustrates a first preferred bristle arrangement of the instant invention. As discussed previously, the brush head is narrow and thin (heightwise), providing easy access to the oral cavity. The most preferred thickness for the head is about 3 mm.

The special bristle arrangement is characterized by a large scooping tuft or bristle bar 86 provided at the use end of the head (the end most distal to the neck portion of the handle). The large scooping tuft 86 may optionally be tilted outward at an angle of approximately two to eight degrees, preferably about three degrees. The scooping tuft 86 reaches behind back teeth and helps remove plaque and food materials which would otherwise be left by a conventional brush.

Surrounding each lateral edge of the head are a plurality of, preferably from three to eight, most preferably five, large gumline tufts 88. These gumline tufts are, optionally, in the form of individual tufts of bristles, or, most preferably in the form of a bristle bar type arrangement. The perimeter gumline tufts 88 are preferably elongated, oval-shaped tufts, and may also be made of rubber or a rubber-like material. Large scooping tuft 86 and opposing first pair of gumline bars 88 act form a cup around a tooth and clean it efficiently. The interior portion of this area is provided with a plurality of densely packed bristle bundles 112' which act to clean the tooth surfaces.

The interior of the brush head is formed with alternating bristle bars 90 and interproximal tufts 92. The bristle bars 90 and interproximal tufts 92 are aligned generally transverse to the longitudinal axis of the brush head. In a most preferred embodiment, the bristle bars 90 are shorter than the bristle tufts 92, allowing the bristle tufts 92 to engage the interproximal spaces between the teeth, and the bristle bars 90 to squeegee the debris from the teeth surface. The bristle bars 90 may be made from standard bristle material, or from a rubberized material. This unique combination of elements gives exceptional cleaning power in a compact head space. The perimeter of the head is provided with gumline bristle bars 88, although such bars 88 could be replaced by individual tufts as in FIG. 17.

Figure 17:
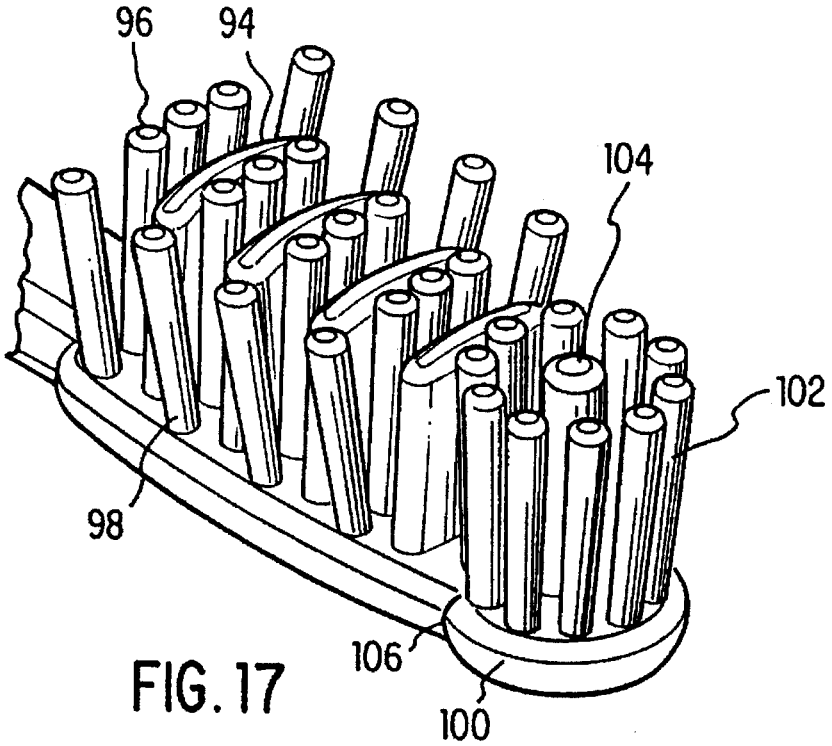
FIG. 17 is a perspective view of a bristle arrangement according to the present invention.

It is theorized that this cleaning power is, in part, due to the smaller open space between bristles. More specifically, the greater concentration of specialized active bristles in a small space is believed to be far more effective than the more conventional wide-open placement of bristle tufts. Preferably, the number of bristle tufts or bars on the head is under 30, FIG. 17 illustrates another embodiment of the present invention. Bristle bars 94, formed of a densely packed or solid wall of bristle material or filaments, or of a rubber-like, rubber, or thermoplastic material, alternate with interproximal bristle tufts 96. The bars 94 are again shorter than the tufts, to as to allow the interproximal tufts 96 to penetrate between the teeth and the bars 94 to remove debris from the tooth surfaces. The bars 94 and tufts 96 are oriented generally perpendicular to the longitudinal axis of the brush head. The bars 94 and tufts 96 are preferably formed with a slight arcuate curve, which assists in the removal of debris. The perimeter of the head is provided with gumline tufts 98, which are slightly angled outward. The gumline tufts are preferably angled outwardly at from two to five, preferably about three, degrees. These tufts act to clean the debris from between the vertical tooth surfaces and the gumline.

The head is formed with a rounded tip 100 having perimeter bristles 102. The perimeter bristles are preferably angled outward slightly, again about 2–5 degrees, preferably about 3 degrees. The rounded tip is also provided with a central densely packed or solid tuft 104, which may optionally be substituted with a gum massager. The rounded tip tuft arrangement 102 encircles the teeth, while the central tuft 104 cleans between teeth and at the gumline. As shown in FIG. 17, the single central densely packed or solid tuft 104 is of greater diameter than circular interproximal tufts 96, circular gumline tufts 98, and circular perimeter bristle 102.

In this embodiment, the indentation 106, where the tapered head meets the rounded tip, clearly defines two distinct use portions. The frontal tip portion acts to power clean specific areas, while the remainder of the head portion acts to clean the teeth in a more broad-brush style, cleaning the surfaces, the gums, and between the teeth in a more traditional style. The toothbrush with different utilization or action segments provides an exceptional tool for the consumer, which enables a much more thorough cleaning job than has heretofore been possible. When combined with the grip properties of the inventive handle, the overall toothbrush is a valuable addition to the consumer's arsenal against oral disease.

Figure 18:
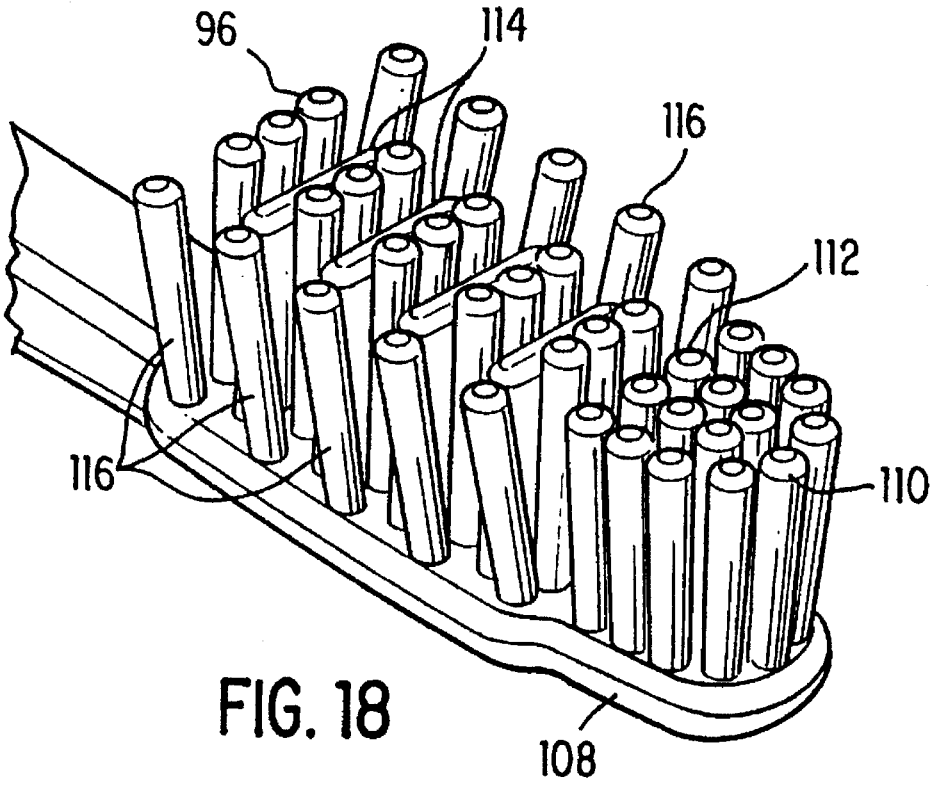
FIG. 18 is a perspective view of a bristle arrangement according to the present invention.

FIG. 18 is a perspective view of a particularly useful embodiment of the present invention. The head is formed with raised portion 108. The perimeter of raised head portion 108 is provided with bristles 110 angled outward slightly, at about two to five degrees, preferably about or exactly three degrees. These bristles act to form a cup around a tooth and clean it efficiently. The interior portion of the raised head portion is provided with densely packed shorter, softer, bristle bundles 112 which act to clean the tooth surfaces. This raised tip concentrates cleaning power without requiring increased brushing force and possible gum damage.

Figure 19:
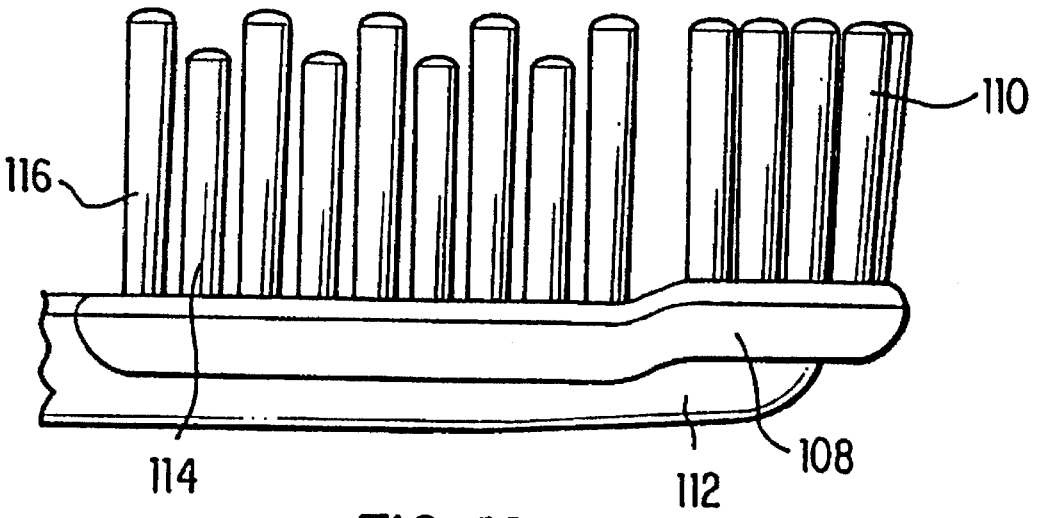
FIG. 19 is a side view of a head-bristle combination arrangement according to the present invention.

FIG. 19 is a side view of FIG. 18, illustrating the raised head portion 108. Support bar 212 is visible in this view, providing support against flexural and torsional use pressure. Bristle bars 114, which squeegee debris away, are clearly visible as shorter than the gumline bristles 116 which clean, inter alia, the surface area, which is where the teeth meet the gumline.

Figure 20:
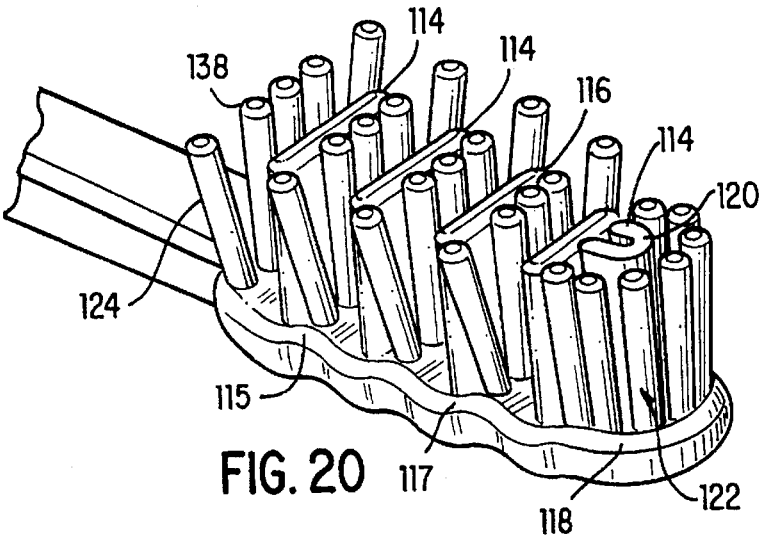
FIG. 20 is a perspective view of a bristle and head arrangement according to the present invention.

FIG. 20 is a perspective view of an embodiment illustrating the waved head. The head, instead of being flat or curved, is formed with a plurality of ridges 115 and valleys 117 which give the toothbrush the cross-sectional shape of a flattened sine wave. The tip portion 118 is On the final raised portion, and is also angled at preferably approximately six degrees upward. An elevational degree from about zero to ten degrees is optimal. Also present are transverse rows of bristle bars 114 alternating with transverse rows of interproximal bristles 138, which rows terminate at their outermost ends with angled gumline bristles 124.

The bristle arrangement in this embodiment has an inner, horse-shoe shaped, bristle bar scoop or tuft 120 for removing debris. The inner scoop is located in the middle of the raised tip portion 118, and the raised tip 118 acts in conjunction with the inner tuft 120 to effectively clean the surface of the tooth. The raised tip portion 118 has a forward perimeter which has a semicircular outer tuft arrangement 122. This outer tuft arrangement cups a tooth and cleanses its vertical fascia.

Figure 21:
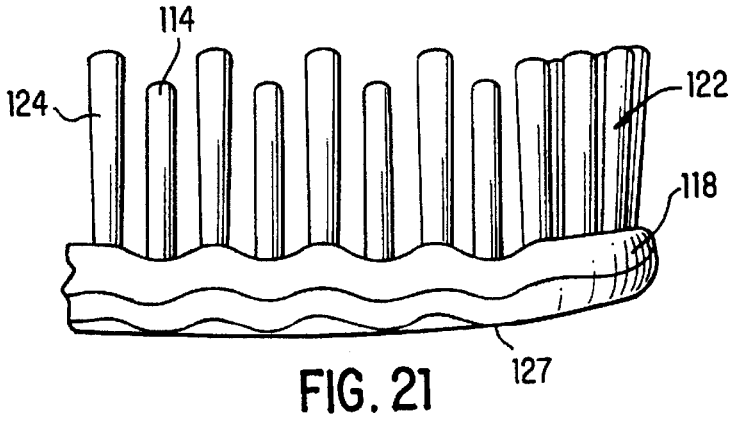
FIG. 21 is a side view of a rubberized head-bristle combination arrangement according to the present invention.

FIG. 21 is a side view of FIG. 20 which more clearly demonstrates the improved feel properties which result from this embodiment. Gumline bristle tufts 124 and bristle bars 114 are formed of the same height of material, imparting a pleasing uniform feel to the toothbrush with the rippled head design. In conventional toothbrushes, such a rippled effect is obtained by placing bristles of differing height in the head. Bristles of differing height have differing flexural moduli, and consequently do not bend uniformly.

This can result in significant and uncomfortable bristle overlap. In the instant preferred embodiment, all bristles are of the same height, all have a uniform, comfortable feel, and will enhance the brushing experience. Further, production costs for this design are substantially lowered, as the bristles may all be of the same stock length, and need not be of differing lengths. This embodiment is given the most preferred resilient rubber layer 127. This layer protects the gums, and acts as a stimulator/massager.

Figure 22:
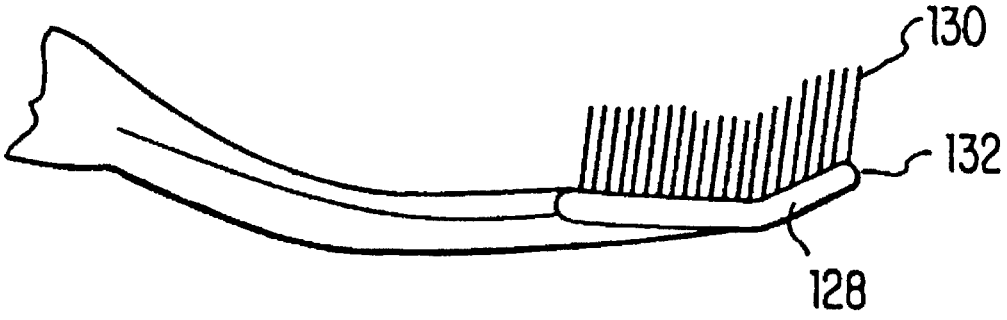
FIG. 22 is a side view of a head-bristle combination according to the present invention.

FIG. 22 illustrates a much preferred tip design. The raised tip 128 is provided with bristles 130 of uniform length, and the use end 132 has a low height as compared to conventional brushes with elongated tip bristles. This improved design enables a user to get in behind the back teeth further, bristles of the same height wear better, more uniformly, and give a longer toothbrush life.

Figure 23:
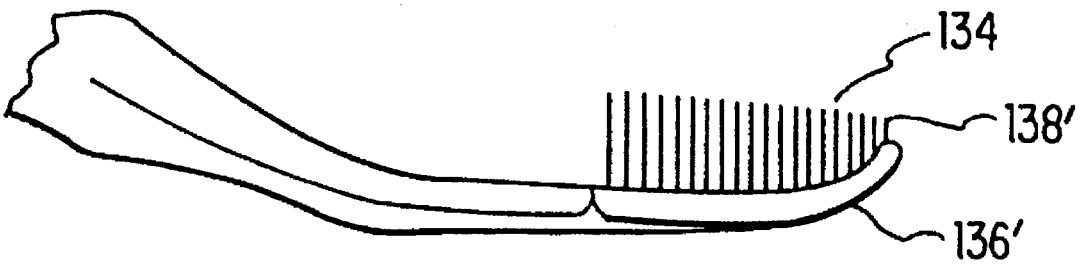
FIG. 23 is a side view of a head-bristle combination according to the present invention.

FIG. 23 is a different embodiment which has level utilization bristle ends 134 on a curved head 136'. The bristles at the very tip 138' are shorter than the remaining head bristles, giving an extremely low profile for difficult access, for example when orthodontic apparatuses are present in the mouth.

Figure 24:
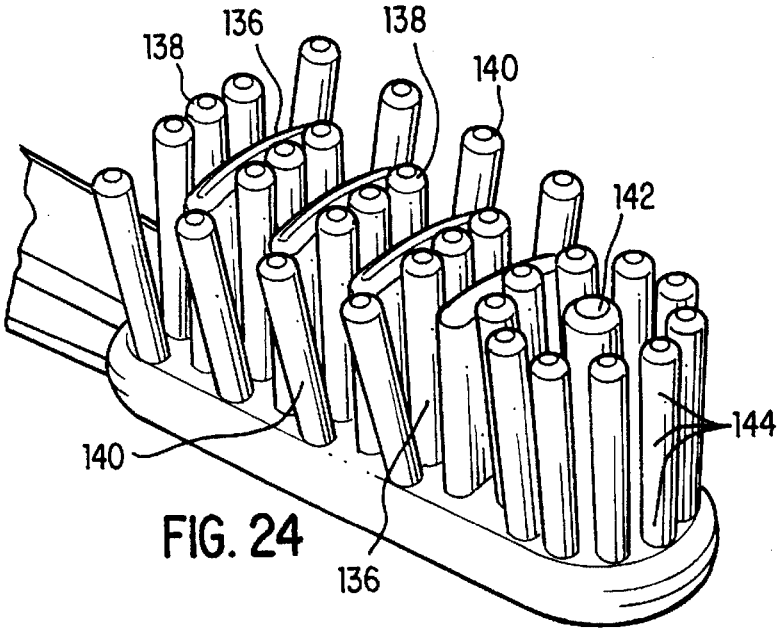
FIG. 24 is a perspective view of a bristle and head arrangement having a gum stimulator according to the present invention.

FIG. 24 illustrates a very preferred bristle arrangement. The bristle bars 136 and interproximal tufts 138 are staggered, with the bars 136 shorter in height than the tufts 138. The gumline bristle tufts 140 are angled at a slight outward angle, preferably from one to fifteen degrees, most preferably about twelve degrees. The forward tip portion is formed with a central gum stimulator 142, formed of rubber or a rubber like material or a dense bristle mass. As shown in FIG. 24, the central gum stimulator 142 is of greater diameter than circular interproximal tufts 138, circular gumline tufts 140, and circular perimeter bristles 144. The forward tip portion is provided with a circular arrangement of angled bristles 144 surrounding the gum stimulator 142. The circularly arranged bristles are preferably slightly outwardly angled, at an angle of from two to five degrees, preferably about three or exactly three degrees.

During brushing action, a rubber gum massager can be stimulating to the gums and simultaneously can act to polish the teeth.

Figure 25:
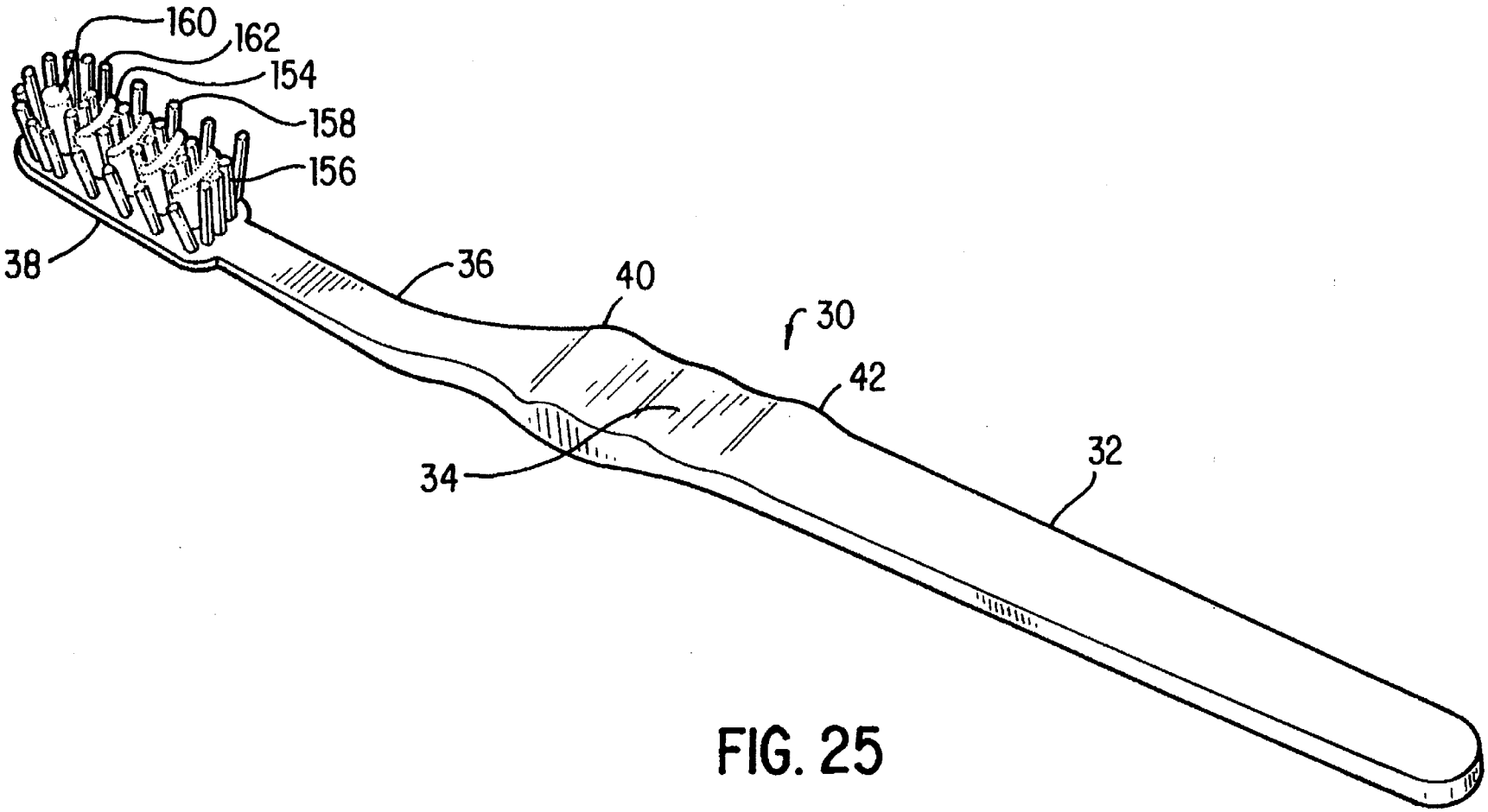
FIG. 25 is a side perspective view of a embodiment of a complete toothbrush according to the present invention, a more detailed head arrangement of which is shown in FIG. 27.
Figure 26:
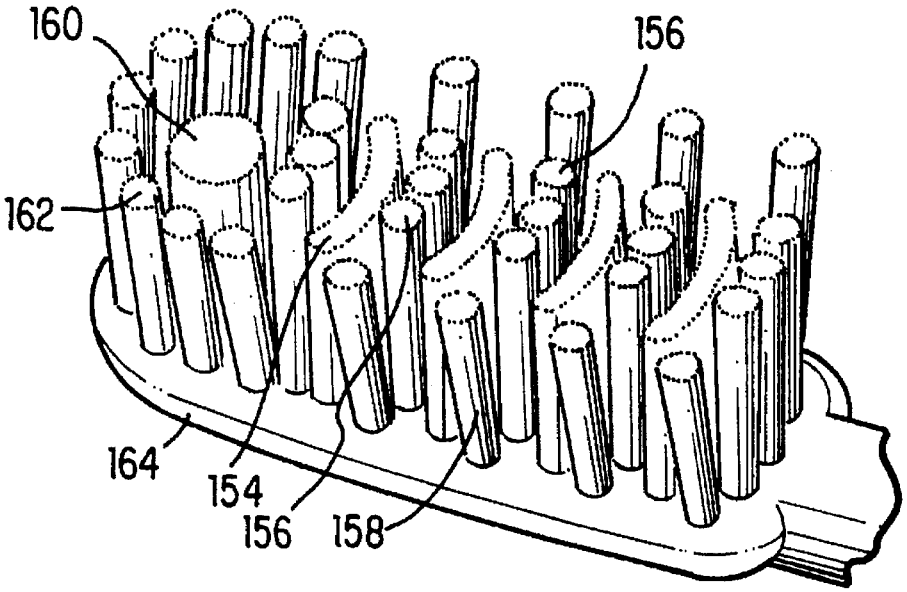
FIG. 26 is a partial perspective view of a bristle arrangement according to the present invention.
Figure 27:
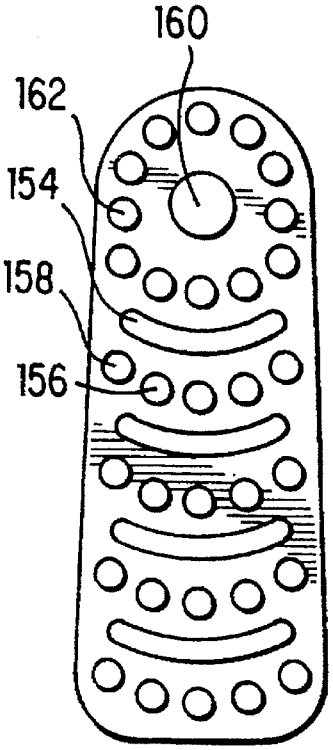
FIG. 27 is a top plan view of a bristle arrangement according to the present invention.

FIG. 25 is a side perspective view of a complete brush according to the instant invention and as more completely shown in FIGS. 26 and 27. The unique combination of elements makes this brush more attractive, highly functional, superior in effectiveness and safer than conventional brushes.

FIG. 26 represents a toothbrush head portion according to the present invention which is particularly preferred. Bristle bars 154 are formed with a slightly arcuate shape which effectively removes debris from the tooth surface and directs it away from the gumline interproximal bristle tufts 156, likewise, are formed with a slight arcuate shape to perform the same function. Gumline perimeter tufts 158 are angled slightly outward, preferably at from two to ten degrees, most preferably about or exactly six degrees. Solid or densely packed brushing means 160 is centrally located in the tip portion of the brush. It may be a dental stimulator, a rubber bar, or a densely packed or solid bristle tuft. Solid or densely packed brushing means 160 is surrounded by tip perimeter bristles 162, which are angled out at about three degrees. The thin head 164 is clearly visible.

FIG. 27 is a top plan view of a most preferred embodiment illustrating the arcuate rows of bristle bars 154 and interproximal tufts 156, which terminate in gumline tufts 158. Tip perimeter bristles 162 join the frontmost arcuate row of bristle tufts to encircle the densely packed or solid brushing means 160. As shown in FIGS. 25, 26, and 27, the single central solid densely packed brushing means 160 is of greater diameter than circular interproximal tufts 156, circular gumline tufts 158, and circular perimeter bristles 162.

Figure 28:
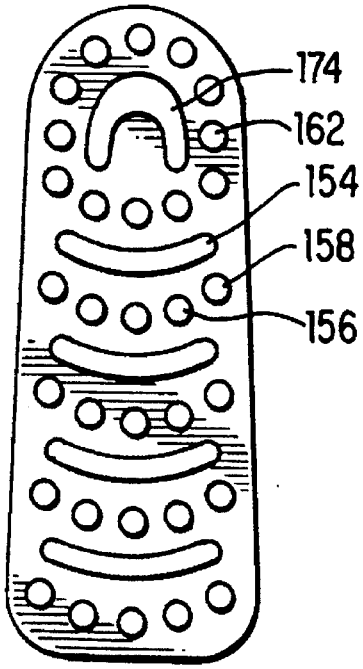
FIG. 28 is a top plan view of a bristle arrangement according to the present invention.

FIG. 28 is a top plan view of a most preferred embodiment illustrating the frontal "U" or "horse-shoe" shaped bristle bar scoop 174, which acts to clear debris from individual teeth and squeegee the debris from the surface and away from the gumline.

"U-shaped," "horse-shoe shaped" and "semicircular," are used herein as synonyms to describe the inner densely packed brushing means, of which reference numeral 114 of FIG. 20 and reference numeral 174 of FIG. 28 are examples.

Brushes according to the instant invention may be manufactured by any one of several technologies currently available. The body itself, as noted above, may be injection molded, in a single or multistep process. While certain of the bristles may be attached by staples as is conventional, the bristle bars, scoops and other densely packed bristles generally must be attached using newer staple-free technology such as fusion, thermoforming, or injection molding. Injection molding is presently preferred. Fusion technology, whereby the brush body is preformed then softened, and the bristle tufts are melted and fused to the softened brush body is useful.

Injection molding is carried out on machinery which is known in the following patents, each of which is expressly incorporated herein by reference: U.S. Pat. No. 4,430,039, issued Feb. 7, 1984; U.S. Pat. No. 4,580,845, issued Apr. 8, 1986; U.S. Pat. No. 5,143,425, issued Sep. 1, 1992; and U.S. Pat. No. 5,390,984, issued Feb. 21, 1995.

Other useful techniques for attaching bristles to a body, such as thermoforming, fusion, welding, and the like are illustrated in the following patents, which are expressly incorporated herein by reference: U.S. Pat. No. 4,109,965, issued Aug. 29, 1978; U.S. Pat. No. 4,619,485 issued Oct. 28, 1986; U.S. Pat. No. 4,637,660, issued Jan. 20, 1987; U.S. Pat. No. 4,646,381, issued Mar. 3, 1987; U.S. Pat. No. 4,892,698, issued Jan. 9, 1990; U.S. Pat. No. 5,045,267, issued Sep. 3, 1991; U.S. Pat. No. 4,988,146, issued Jan. 29, 1991; and U.S. Pat. No. 5,224,763, issued Jul. 6, 1993.

Staple-free attachment results in no holes in the brush body, where water could collect and bacteria and germs grow. Most preferred is supplying the bristles to an injection mold, and injection molding the brush body around the bristles for a tight fit. The rubber grips may be injection molded over the body.

Other variants conceived by the applicant include a compact head version wherein the head is no larger than 2.25 mm, wherein the head is substantially shorted. Also contemplated is a full head variant having a head of about 2.5 to 3.5 mm. Bristles of varying length, stock, stiffness, and thickness all are contemplated by the inventor, Generally speaking, the present invention is directed to a toothbrush having a head portion and a connected handle portion along a longitudinal axis, wherein the head portion has a first region distal to the handle, a second region proximal to the handle, and a perimeter surrounding the head. The head includes brushing means, and the handle portion is formed from thermoplastic materials. The brushing means includes: a first brush area on the first region distal to the handle, which first brush area contains an outer brush perimeter region surrounding an inner, more densely packed brush area; and a second brush area on the second region proximal to the handle, which second brush area contains alternating bristle bar tufts and individual tufts of bristles which are oriented substantially transverse to the longitudinal axis, and the rows of individual tufts of bristles end in laterally outwardly extending gumline bristles or bars.

Other variants will become apparent to those of skill in the art having regard for the instant disclosure.

Having described my invention in the foregoing specification,

I claim:

1. A toothbrush comprising a head portion and a handle portion connected thereto along a longitudinal axis, the head portion having brushing means thereon, wherein the handle portion is formed from a thermoplastic material, and wherein the head portion has a first region distal to the handle portion, a second region proximal to the handle portion and a perimeter surrounding the head portion, wherein the brushing means comprises:

(a) a first brush area on said first region distal to said handle portion, said first brush area including an outer brush perimeter region at the free end of said head portion, said outer brush perimeter region being arranged in an arcuate pattern on said free end and further defining an inner area thereon in which an inner densely packed brush area is located; and (b) a second brush area on said second region proximal to said handle portion, said second brush area containing alternating bars and rows of interproximal tufts which are oriented substantially transverse to the longitudinal axis, wherein said rows of interproximal tufts end in one selected from the group consisting of laterally outwardly extending gumline bristles and laterally outwardly extending gumline bars.

2. A toothbrush as claimed in claim 1, wherein said inner densely packed brush area is comprised of a u-shaped scooping tuft of bristles.

3. A toothbrush as claimed in claim 1, wherein said inner densely packed brush area is a u-shaped scooping bar selected from the group consisting of rubber and rubber-like material.

4. A toothbrush as claimed in claim 1, wherein said inner densely packed brush area is comprised of a semicircular shaped scooping tuft of bristles.

5. A toothbrush as claimed in claim 1, wherein said inner densely packed brush area is a semicircular shaped scooping bar selected from the group consisting of rubber and rubber-like material.

6. A toothbrush as claimed in claim 1, wherein said inner densely packed brush area is comprised of a circular shaped tuft of bristles of larger diameter than any of the interproximal tufts and gumline tufts on said second brush area.

7. A toothbrush as claimed in claim 1, wherein said inner densely packed brush area is a circular shaped bar selected from the group consisting of rubber and rubber-like material.

8. A toothbrush as claimed in claim 1, wherein said inner densely packed brush area is comprised of a horseshoe shaped tuft of bristles.

9. A toothbrush as claimed in claim 1, wherein said inner densely packed brush area is a horseshoe shaped bar selected from the group consisting and rubber or rubber-like material.

10. A toothbrush as claimed in claim 1, wherein the transverse bars and interproximal tufts are arranged in an arc.

11. A toothbrush as claimed in claim 1, wherein said outer brush perimeter region in said first brush area is provided with a semicircular bristle arrangement.

12. A toothbrush as claimed in claim 11, wherein said semicircular bristle arrangement comprises a plurality of bristle tufts.

13. A toothbrush as claimed in claim 11, wherein said semicircular bristle arrangement is selected from one of a group consisting of a semicircular rubber and rubber-like bar.

14. A toothbrush as claimed in claim 12, wherein said plurality of bristle tufts are angled outwardly at about three degrees.

15. A toothbrush as claimed in claim 13, wherein said semicircular bar is angled outwardly at about three degrees.

16. A toothbrush as claimed in claim 1, wherein said perimeter of said head portion is provided with a plurality of bristles selected from one of a group consisting of tufts and bristle bars angled slightly outwardly.

17. A toothbrush as claimed in claim 16, wherein said perimeter bristle bristles are in the form of a plurality of bristle tufts.

18. A toothbrush as claimed in claim 16, wherein said plurality of bristles comprise a plurality of perimeter bristle bars selected from one of a group consisting of a rubber and rubber-like material.

19. A toothbrush as claimed in claim 17, wherein said perimeter bristle tufts are oval shaped.

20. A toothbrush as claimed in claim 18, wherein said perimeter bristle bars are oval shaped.

21. A toothbrush as claimed in claim 1, wherein said alternating bars are shorter than the interproximal tufts.

22. A toothbrush as claimed in claim 1, wherein the number of tufts and bars on said head portion is under 30.

23. A toothbrush as claimed in claim 1, wherein said densely packed brush area is a central densely packed tuft of bristles.

24. A toothbrush as claimed in claim 1, wherein said inner densely packed brush area is comprised of one selected from the group consisting of a central solid rubber and rubber-like bar.

25. A toothbrush as claimed in claim 1, wherein said inner densely packed brush area is a gum massager.

26. A toothbrush as claimed in claim 1, wherein said inner densely packed brush area on said first region is comprised of densely packed short and soft bristles.

27. A toothbrush as claimed in claim 1, wherein said first brush area and said second brush area provide visibly distinct utilization portions.

28. A toothbrush as claimed in claim 1, wherein said head portion is formed with a rounded free end tip.

29. A toothbrush as claimed in claim 1, wherein said head portion is formed with a wave profile.

30. A toothbrush as claimed in claim 1, wherein said head portion has a bottom, and said bottom is provided with a resilient layer.

31. A toothbrush as claimed in claim 30, wherein said resilient layer is comprised of one selected from the group consisting of rubber and a deformable thermoplastic material.

32. A toothbrush as claimed in claim 1, wherein said head portion is formed of a layer of thermoplastic material of about 3 mm in thickness, and has a support bar formed integral to said head portion and connected to said handle portion, said support bar tapering to a point under said head portion, whereby support for said head portion is provided; and wherein said head portion is provided with a portion which is displaced from the horizontal; said head portion is tapered to narrow to the free end portion which is the use end portion; and said head portion is formed with a rounded free end portion.

33. A toothbrush as claimed in claim 32, wherein the displacement of said head portion is in the form of an upward angle at the free end tip.

34. A toothbrush as claimed in claim 32, wherein the displacement of said head portion is in the form of an upward curve at the free end tip.

35. A toothbrush as claimed in claim 32, wherein the displacement of said head portion is in the form of an elevated portion curve at the free end tip.

36. A toothbrush as claimed in claim 32, wherein the displacement of said head portion is in the form of a wave profile along the longitudinal axis.

37. A toothbrush as claimed in claim 32, wherein said head portion has a bottom, and said bottom is provided with a resilient layer.

38. A toothbrush as claimed in claim 1, wherein said head portion is formed of a layer of thermoplastic material of up to 5 mm; a support bar is formed integral to said head portion and connected to said handle portion; and said handle portion is formed with a first grip portion having a plurality of upper protrusions forming indentations, and a second grip portion formed on the opposite side of said handle portion from the first grip portion, said second grip portion being formed with at least two indented curvatures proximate to one another forming a lower protrusion.

* * * * *